US005712555A

United States Patent [19]

Jackson et al.

[11] Patent Number: 5,712,555

[45] Date of Patent: Jan. 27, 1998

[54] VOLTAGE REGULATION FOR ACCESS CARDS

[75] Inventors: Thomas Jackson, Frederick; Stephen H. Jones, Gaithersburg, both of Md.

[73] Assignee: Hughes Electronics, Los Angeles, Calif.

[21] Appl. No.: 600,578

[22] Filed: Feb. 13, 1996

[51] Int. Cl.[6] ..... G05F 1/40; G05F 1/44

[52] U.S. Cl. ..... 323/273; 323/274

[58] Field of Search ..... 323/273, 274, 323/275, 278, 277, 286, 349, 303

[56] References Cited

U.S. PATENT DOCUMENTS

| | | | |
|---|---|---|---|
| 4,006,400 | 2/1977 | Fett et al. | 323/1 |
| 4,538,102 | 8/1985 | Takagi et al. | 323/349 |
| 4,574,232 | 3/1986 | Petty | 323/268 |
| 4,593,338 | 6/1986 | Takeda et al. | 323/275 |
| 4,605,891 | 8/1986 | Wrathall | 323/313 |
| 4,650,981 | 3/1987 | Foletta | 235/449 |
| 4,743,833 | 5/1988 | Johnson | 323/278 |

*Primary Examiner*—Peter S. Wong
*Assistant Examiner*—Bao Q. Vu
*Attorney, Agent, or Firm*—John Whelan; Wanda Denson-Low

[57] ABSTRACT

The present invention relates to an apparatus and method for voltage regulation. The apparatus includes an error amplifier circuit in communication with an external reference voltage input. The error amplifier circuit produces an error voltage that is proportional to the difference between an external reference input voltage and an output voltage. A series pass circuit is in communication with the error amplifier circuit and is responsive to the error voltage. The method comprises the steps of comparing an external reference voltage to an output voltage, generating an error voltage proportional to the difference between the external reference voltage and the output voltage, and regulating the output voltage based upon the error voltage.

17 Claims, 2 Drawing Sheets

VOLTAGE REGULATION FOR ACCESS CARDS

BACKGROUND OF THE INVENTION

The present invention relates generally to satellite communication systems, and more particularly, to a method and apparatus for voltage regulation.

Advances in satellite communication and broadcast formats have allowed households to receive over 100 channels of digital video. Generally, a ground-based transmitter beams up a signal to a satellite positioned in a geosynchronous orbit. The satellite in turn relays the signal back to a satellite dish of a ground-based subscriber receiving station. The satellite dish transmits the signal through a cable to a video processor unit. The video processor unit is usually equipped with an access card that enables the unit to decode the signals that are broadcast from the satellite.

In a typical video processor unit, the access card is inserted in a slot in the front of the video processor unit. After the card is inserted, voltage may be supplied by the video processor unit to activate the access card. When supplying voltage to the access card, both the supply voltage and the signal line voltages usually have to interface with the access card and the supply voltage should not drop below the signal line voltages.

Stand alone voltage regulators, or similar regulators integrated into a power supply IC, have been used to regulate the supply voltage to access cards. However, these devices send a regulated supply voltage to the access card that is independent of a user supplied reference. As a result, the supply voltage may drop below the signal line voltages unless the tolerance of the supply voltage is tightened. However, tightening the tolerance of the supply voltage may be expensive.

MOSFET switch drivers have also been used to regulate the supply voltage to access cards. Although MOSFET switch drivers supply a rail voltage directly to a load, the supply voltage may fall below the signal line voltages because of the voltage drop in the MOSFET switch and the current sensing element. Furthermore, it is difficult to incorporate the rise time, fall time, and slew rate control into the architecture of the MOSFET switch circuit.

Traditional smart card interface ASICs, such as those manufactured by Philips, have also been used to regulate the supply voltage to the access cards. These devices incorporate a voltage supply, a signal interface, and/or clock generating functions on a single chip. However, these devices are relatively expensive and usually do not allow the designer or engineer any flexibility in distributing the voltage supply, signal, and clock functions to different parts of an external circuit, such as a video processor unit.

Accordingly, there is a need for an apparatus and method to regulate the supply voltage to an access card. It would be desirable if the supply voltage of such an apparatus would be responsive to an external reference voltage. It would also be beneficial if such an apparatus would be relatively inexpensive.

SUMMARY OF THE INVENTION

In order to address the above need, the present invention provides a method and apparatus for regulating a supply voltage to an access card. The supply voltage preferably tracks an external reference voltage, and the supply voltage to the access card is preferably higher or equal to the signal line voltages. The apparatus is inexpensive to manufacture and provides voltage accuracy and regulation, current limiting, rise time/fall time/slew rate control, and logic controlled shutdown.

In one aspect of the invention, the apparatus includes an error amplifier circuit in communication with an external reference voltage input. The error amplifier circuit produces an error voltage that is proportional to the difference between an external reference input voltage and an output voltage. A series pass circuit is in communication with the error amplifier circuit and is responsive to the error voltage.

In another aspect of the invention, the apparatus includes an error amplifier circuit in communication with an external reference voltage input. The error amplifier circuit produces an error voltage that is proportional to the difference between the external reference input voltage and an output voltage. A series pass circuit is responsive to the error voltage, and a current sensing circuit is in communication with the series pass circuit. An output is in communication with the current sensing circuit.

In another aspect of the invention, a method of regulating voltage is provided. The method comprises the steps of comparing an external reference voltage to an output voltage, generating an error voltage proportional to the difference between the external reference voltage and the output voltage, and regulating the output voltage based upon the error voltage.

It is to be understood that both the foregoing general description and the following detailed description are exemplary and explanatory and are intended to provide further explanation of the invention as claimed.

The invention, together with further objects and attendant advantages, will best be understood by reference to the following detailed description of the presently preferred embodiment of the invention, taken in conjunction with the accompanying drawings.

DESCRIPTION OF THE PREFERRED EMBODIMENT

Figure 1:
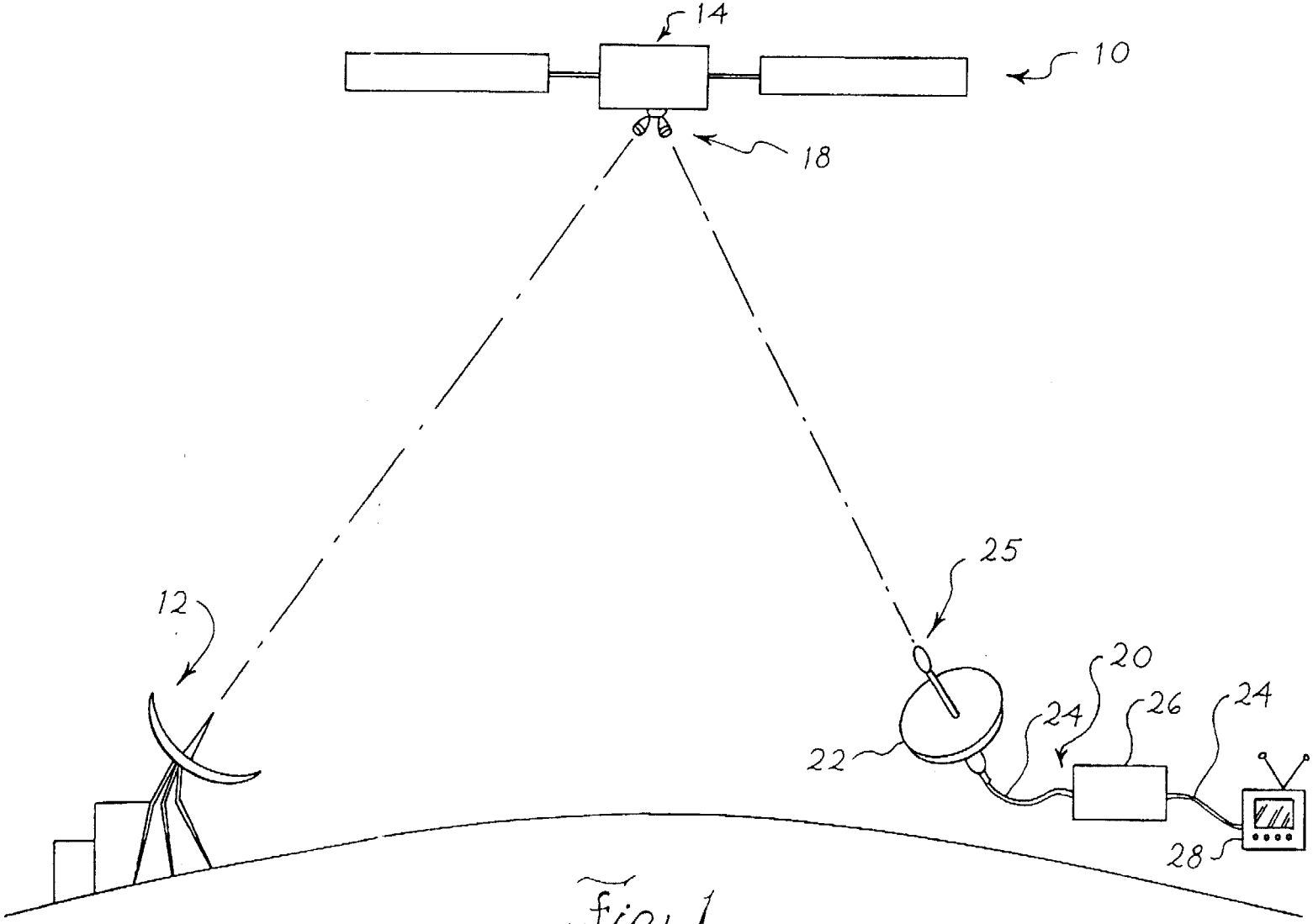
FIG. 1 is a diagram of a satellite television system including a ground-based subscriber receiving station for receiving and decoding signals transmitted from a satellite.

Referring now to the drawings, and particularly to FIG. 1, a preferred embodiment of a satellite television system 10 is illustrated. The system 10 allows customers to receive over 100 television channels broadcast from a satellite 14. The system 10 preferably includes a ground-based uplink facility 12, a space segment that includes a satellite 14, and a ground-based subscriber receiving station 20. The ground-based uplink facility 12 preferably gathers programming information via satellite 14, terrestrial fiber optic paths, or pre-recorded programming stored on a tape. The ground-based uplink facility 12 digitally modulates the programming information and beams the information at 17.3–17.8 GHz to the satellite 14.

The satellite 14 is preferably a geosynchronous satellite, such as the Hughes® HS-601™ spacecraft, positioned at a geosynchronous orbital location at approximately 101° W longitude. The satellite 14 preferably has high power transponders 18 to receive the uplinked signals. The satellite 14 translates the signal from the ground-base uplink facility 12 to 12.2–12.7 GHz, and then beams the signals via the transponders 18 to the ground-based subscriber receiving station 20.

In a preferred embodiment, the ground-based subscriber receiving station 20 includes a satellite dish 22 connected by a cable 24 to a video processor unit 26. The satellite dish 22 is aimed toward the satellite 14, and the video processor unit 26 is connected to a television 28 in a similar fashion to a conventional VCR. The satellite dish 22 captures the signals from the satellite 14 and focuses the signals to a feed 25. The feed 25 converts the focused signals to an electrical signal which is amplified and down-converted in frequency by a low noise block (LNB) 32 (see FIG. 2). Preferably, the LNB 32 down-converts the signals to 32 carrier frequencies between 950 MHz to 1450 Mhz. The amplified and down-converted signals are then transmitted via coaxial cable 24 to the video processor unit 26.

Figure 2:
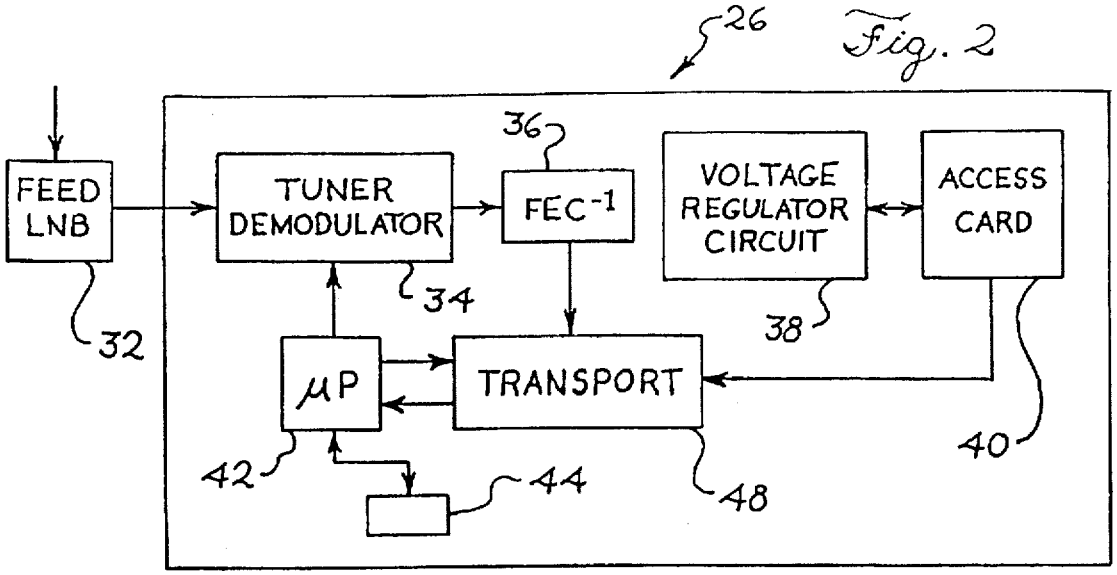
FIG. 2 is a block diagram illustrating a preferred embodiment of the video processor unit embodying a voltage regulation circuit made in accordance with the present invention.

FIG. 2 shows a diagram of the presently preferred components of the video processor unit 26. The components of the video processor unit 26 preferably include a tuner/demodulator 34, a transport integration circuit 48, a forward error correction circuit 36, a voltage regulation circuit 38, an access card 40, a micro-controller 42, and an interface 44. Preferably, the components occupy part of a single printed circuit board in the video processor unit 26. The tuner/demodulator 34 tunes to a selected carrier signal transmitted from the satellite dish 22 based upon channel selection instructions received from the micro-controller 42 via the interface 44. After tuning to the desired carrier, the tuner/demodulator 34 decodes the selected signal carrier into a digital packet stream. The digital packet stream is then sent to the forward error-correction circuit 36.

The forward error-correction circuit 36 ensures that all bits are transmitted with little or no errors. After the forward error-correction circuit 36 corrects any errors, the signal may be routed to the transport integration circuit 48. The transport integration circuit 48 reads the security information from the access card 40 and then decodes the signal. After the data is decoded, the data is relayed to the audio and video de-compression circuits (not shown). The audio data is then transferred to a dual D/A converter (not shown) where the left and right audio channel are also mixed together to create a mono audio output for the AM modulator.

The micro-controller 42 controls the overall operation of the video processor unit 26, including the selection of parameters, the set up and control components, channel selection, viewer access to different programming packages, and many other functions. The microprocessor 42 receives input from the interface 44, such as an IR remote and/or keyboard, and interfaces with a memory, such as ROM which contains programming software.

Figure 3:
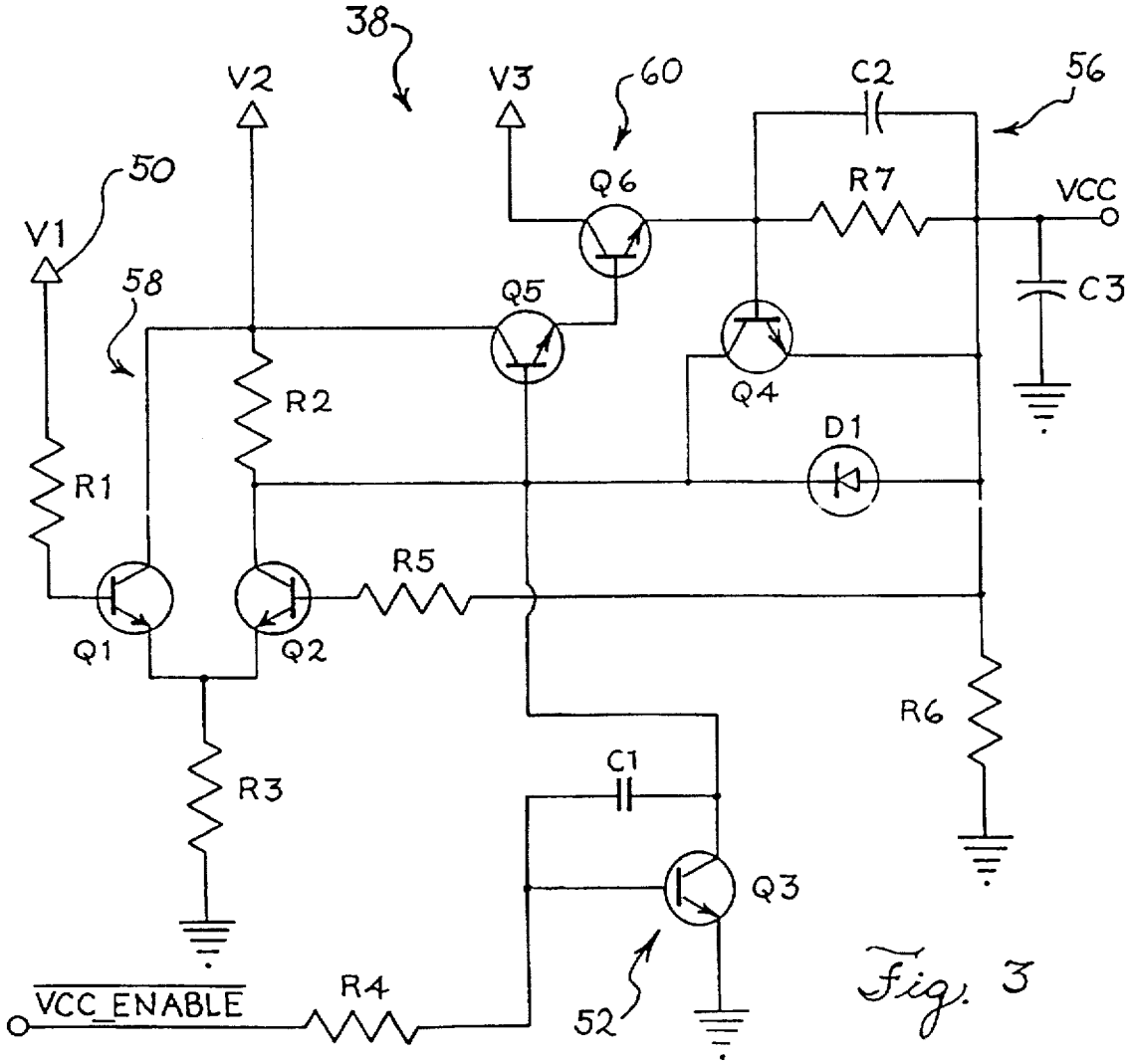
FIG. 3 is a schematic diagram of a preferred embodiment of the voltage regulator shown in FIG. 2.

Referring to FIG. 3, a preferred embodiment of the voltage regulation circuit 38 for the access card 40 is shown. The voltage regulation circuit 38 is preferably part of the single printed circuit board in the video processor unit 26. The voltage regulation circuit 38 may be used as a voltage supply for ISO standard 7816 access cards or PCMCIA cards.

In a preferred embodiment, the voltage regulation circuit 38 comprises a reference voltage input 50, an enable circuit 52, an error amplifier circuit 58, a series pass circuit 60, and a current sensing circuit 56. The voltage regulation circuit 38 allows the output or supply voltage Vcc to track unit-to-unit variation in the maximum signal voltage by responding to an external voltage reference $V_1$. The external voltage reference $V_1$ is applied to the input 50 of the voltage regulation circuit 38. Preferably, the external voltage $V_1$ is about 5V.

The error amplifier circuit 58 preferably comprises a differential pair of transistors $Q_1$ and $Q_2$. The error amplifier circuit 58 compares the external reference voltage $V_1$ with the output or supply voltage Vcc which is typically about 5V. The transistors $Q_1$ and $Q_2$ are preferably a matched pair and a part of a single transistor array. The single transistor array is preferably model number CA3083. The transistors $Q_1$ and $Q_2$ are biased by voltage $V_2$ and resistors $R_1$, $R_2$, $R_3$, and $R_5$. Preferably, the resistances of $R_1$, $R_2$, $R_3$, and $R_5$ are about 1K, 2.55K, 1K, and 1K respectively, and $V_2$ is preferably about 12 volts. It is contemplated that a 9.1V Zener diode may be used to drop a voltage source of 21V to about 12V for the voltage $V_2$.

The error amplifier circuit 58 preferably produces an error voltage at the collector of transistor $Q_2$ that is proportional to the difference between external reference voltage $V_1$ and the output voltage Vcc. The error voltage drives the series pass circuit 60. The series pass circuit 60 preferably comprises a Darlington pair $Q_5$ and $Q_6$. The transistor $Q_6$ may be referred to as a series pass resistor. Preferably, the transistor $Q_6$ may be a power transistor, model number PZT2222A, and the transistor $Q_5$ may be part of the single transistor array, model number CA3083.

In a preferred embodiment, the Darlington pair $Q_5$ and $Q_6$ tightly regulates the output voltage Vcc and responds quickly to keep the error voltage between the external reference voltage $V_1$ and the output voltage Vcc small. For example, if the external reference voltage $V_1$ is greater than the output voltage Vcc, the voltage driving the base of transistor $Q_5$ increases causing more current to flow into the base of transistor $Q_6$. As the transistor $Q_6$ passes more current, the output voltage Vcc will begin to rise toward the regulated input voltage $V_3$. The regulated input voltage $V_3$ is preferably greater than the desired output voltage Vcc by an amount at least as large as the dropout voltage of the regulator. Preferably, the regulated input voltage $V_3$ is about 6.5V.

When the transistors $Q_5$ and $Q_6$ are turned on, current flows from the regulated input voltage $V_3$ through transistor $Q_6$, and resistor $R_7$ senses the amount of current flowing to the external device powered by output voltage Vcc. The resistor $R_7$preferably produces a voltage drop at the desired maximum output current to force transistor $Q_4$ into conduction. As the current increases through the resistor $R_7$, transistor $Q_4$ will turn on. When the transistor $Q_4$ turns on, current will be drawn away from the Darlington pair $Q_5$ and $Q_6$ and transistor $Q_5$ will begin to turn off. Subsequently, the series pass transistor $Q_6$ will also tend to turn off and the output voltage Vcc will fall toward ground. Preferably, the transistor $Q_4$ may be part of the single transistor array, model number CA3083, and the resistance of resistor $R_7$ is about 4.75 ohms.

An output filter capacitor $C_3$ may be coupled between the output voltage Vcc and ground. Preferably, the output filter capacitor $C_3$ should be large enough for adequate filtering of the output voltage Vcc and for limiting the slew rate of the output voltage Vcc during on and off transitions. It should also be small enough to meet minimum rise and fall time requirements for the output voltage Vcc. Preferably, the capacitor $C_3$ may be about 0.47 μF.

In a preferred embodiment, a capacitor $C_2$ is used to meet the current pulse requirements of the output voltage Vcc. If the value of the capacitor $C_3$ is too small and the current limit of the power supply is too low, the capacitor $C_3$ will not hold adequate charge to maintain the output voltage Vcc at its minimum level during current pulses drawn by the load. In that case, the capacitor $C_2$ will bypass the current sensing circuit 56 to respond to output current pulses. Preferably, the capacitor $C_2$ may be about 22 μF.

In a preferred embodiment, a diode $D_1$ may be used in order for the output voltage Vcc to meet minimum turn-off time specifications. When the voltage regulation circuit 38 is switched off, there may be no load attached to the voltage regulation circuit 38 and capacitor $C_3$ has to discharge into a relatively high impedance. The diode $D_1$ provides a discharge path to a low impedance so that the output voltage Vcc may reach a low logic level shortly after a turnoff command is issued. Preferably, the diode may be a Schottky diode, model number MMBD301L, and the resistance of resistor $R_6$ may be about 402 ohms.

In a preferred embodiment, the voltage regulation circuit 38 is activated by the enable circuit 52. The enable circuit 52 is implemented with transistor $Q_3$, resistor $R_4$, and capacitor $C_1$. When the active low Vcc_Enable is low, the transistor $Q_3$ is off, and the regulation circuit 38 operates normally. When active low Vcc_Enable is high, the transistor $Q_3$ turns on, drawing current away from the Darlington pair $Q_5$ and $Q_6$ thereby shutting off the series pass transistor $Q_6$. The capacitor $C_1$ may be used to slow down the rise time of the output voltage Vcc which may be sped up by the presence of capacitor $C_2$. Preferably, the transistor $Q_3$ may be part of the single transistor array, model number CA3083, the capacitor C, may be about 1000 pF, and the resistance of resistor $R_4$ may be about 2.55K.

The voltage regulator circuit 38 regulates the output voltage to the access card. The output voltage tracks the external voltage $V_1$ to prevent the output voltage from dropping below the signal line voltages. The voltage regulation circuit provides voltage accuracy and regulation, current limiting, rise time/fall time/slew rate control, and logic controlled shutdown.

Although the present invention has been described in detail by way of illustration and example, it should be understood that a wide range of changes and modifications can be made to the preferred embodiment described above without departing in any way from the scope and spirit of the invention. For example, although the preferred embodiment shows discrete components, the voltage regulation circuit 38 may be an integrated chip. Thus, the described embodiment is to be considered in all respects only as illustrative and not restrictive, and the scope of the invention is, therefore, indicated by the appended claims rather than the foregoing description. All changes that come within the meaning and range of equivalency of the claims are to be embraced within their scope.

What is claimed is:

1. A voltage regulation circuit for an access card requiring a regulated supply signal having a rise-time within a first predetermined range and a fall-time within a second predetermined range, the voltage regulation circuit comprising:

a voltage regulator having an output terminal for coupling a regulated output voltage signal to an access card, the voltage regulator including means for receiving an external reference voltage input signal from a source external to the voltage regulator; and an enable circuit in communication with the voltage regulator for enabling the voltage regulator at a first time such that the output terminal of the voltage regulator substantially receives the regulated output voltage signal by a rise-time within the first predetermined range after the first time, and for disabling the voltage regulator at a second time such that the output terminal of the voltage regulator substantially ceases to receive the regulated output voltage signal and reaches a ground potential within a fall-time within the second predetermined range after the second time;

wherein the output voltage signal substantially tracks the external reference voltage input signal when the voltage regulator is enabled.

2. The voltage regulation circuit of claim 1, wherein the voltage regulator comprises an error amplifier responsive to the regulated output voltage signal and the external reference voltage input signal for producing a voltage error signal proportional to the difference between the external reference voltage input signal and the output voltage signal and a series pass circuit responsive to the voltage error signal for controlling current flow to the output terminal such that the output voltage signal substantially tracks the external reference voltage input signal when the voltage regulator is enabled.

3. The voltage regulation circuit of claim 2, wherein the error amplifier circuit comprises a pair of transistors.

4. The voltage regulation circuit of claim 2, further comprising a current sensing circuit in communication with the series pass circuit.

5. The voltage regulation circuit of claim 4 wherein the current sensing circuit comprises a transistor in communication with a resistor.

6. The voltage regulation circuit of claim 2, wherein the series pass circuit comprises a pair of transistors.

7. The voltage regulation circuit of claim 6 wherein the pair of transistors comprises a Darlington pair.

8. The voltage regulation circuit of claim 2, further comprising a capacitor in communication with the output terminal and the series pass circuit.

9. The voltage regulation circuit of claim 2, further comprising a diode in communication with the output terminal and the enable circuit.

10. The voltage regulation circuit of claim 2, wherein the enable circuit comprises a resistor, a transistor, and a capacitor.

11. A method of providing voltage to an access card having an input terminal and requiring a supply voltage having a rise-time within a first predetermined range and a fall-time within a second predetermined range, the method comprising the steps of:

generating an output voltage using a voltage regulator having an output terminal, means for receiving an external reference voltage input signal from a source external to the voltage regulator, and means for ensuring that the output voltage substantially tracks the external reference voltage input signal;

coupling the output terminal of the voltage regulator to the input terminal of an access card;

turning on the voltage regulator at a first time such that the input terminal of the access card substantially receives the output voltage by a rise-time within the first predetermined range after the first time; and turning off the voltage regulator at a second time such that the input terminal of the access card substantially ceases to receive the output voltage and reaches a ground potential by a fall-time within the second predetermined range after the second time.

12. The method of claim 11, wherein the voltage regulator performs the steps of:

comparing the external reference voltage input signal to the output voltage;

generating an error voltage proportional to the difference between the external reference voltage input signal and the output voltage; and regulating the output voltage based upon the difference between the external reference voltage input signal and the output voltage.

13. The method of claim 12, wherein the voltage regulator further performs the step of sensing the current flowing to the output voltage.

14. The method of claim 12, wherein the voltage regulator further performs the step of enabling the current to flow to the output voltage.

15. The method of claim 12, wherein the step of regulating the output voltage further comprises increasing the output voltage when the external reference voltage input signal is greater than the output voltage.

16. The method of claim 12 wherein the step of regulating the output voltage further comprises decreasing the output voltage when the external reference voltage input signal is less than the output voltage.

17. The method of claim 12, wherein the voltage regulator further performs the step of driving a Darlington pair with the error voltage.

* * * * *